United States Patent [19]

Cunningham et al.

[11] 4,018,160

[45] Apr. 19, 1977

[54] AIR CONDITIONING TERMINAL

[75] Inventors: Kenneth K. Cunningham, N. Syracuse; Carl C. Herb, Camillus, both of N.Y.

[73] Assignee: Carrier Corporation, Syracuse, N.Y.

[22] Filed: June 10, 1975

[21] Appl. No.: 585,560

[52] U.S. Cl. ..... 98/40 D; 98/40 C

[51] Int. Cl.[2] ..... F24F 13/08

[58] Field of Search ..... 98/40 C, 40 D, 40 R, 98/103; 236/49

[56] References Cited

UNITED STATES PATENTS

| | | | |
|---|---|---|---|
| 3,126,811 | 3/1964 | Kennedy | 98/40 D |
| 3,185,069 | 5/1965 | Stranb et al. | 98/40 D |
| 3,308,744 | 3/1967 | Schach | 98/40 D |
| 3,554,112 | 1/1971 | Herb | 98/40 D |
| 3,703,140 | 11/1972 | Gutheim | 98/40 D |
| 3,730,071 | 5/1973 | Gutheim et al. | 98/40 D |
| 3,796,367 | 3/1974 | Rifkin | 98/40 D |
| 3,837,267 | 9/1974 | Lambert | 98/40 D |
| 3,980,007 | 9/1976 | Herb | 98/40 D |

FOREIGN PATENTS OR APPLICATIONS

| | | | |
|---|---|---|---|
| 848,725 | 8/1970 | Canada | 98/40 D |

*Primary Examiner*—William F. O'Dea
*Assistant Examiner*—Henry C. Yuen
*Attorney, Agent, or Firm*—J. Raymond Curtin; Barry E. Deutsch

[57] ABSTRACT

An air conditioning terminal for supplying conditioned air into a space includes a pair of assemblies for regulating the quantity of air discharged from the terminal. A restraining member is connected to the air regulating assemblies and to a non-movable portion of the terminal to prevent relative movement between the air regulating assemblies and the non-movable portion.

1 Claim, 2 Drawing Figures

AIR CONDITIONING TERMINAL

BACKGROUND OF THE INVENTION

This invention relates to an air conditioning terminal, and in particular, to an arrangement of parts whereby undesirable noise generation is prevented.

The utilization of air conditioning terminals to supply conditioned air from a central source thereof to offices, school rooms, and other similar spaces in multi-room buildings has become increasingly prevalent. Such terminals are typically located in the ceiling of the rooms being conditioned, or on the floor thereof adjacent the windows. The use of such terminals in rooms that are normally occupied by people dictates that the conditioned air be discharged from the terminals as quietly as possible. That is to say, noise generated by operation of the terminals should be maintained at a minimum.

An air conditioning terminal of the type suitable for installation in the ceiling that has met with widespread commercial success is disclosed in U.S. Pat. No. 3,554,111, issued Jan. 12, 1971 and assigned to the same assignee as the assignee hereof.

The terminal disclosed in the aforecited patent includes an assembly for regulating the quantity of conditioned air discharged into the room or space being conditioned in accordance with the actual temperature requirements of the occupants thereof. Such air regulating assembly includes an inflatable bellows, the amount the bellows is inflated varying inversely with the quantity of conditioned air discharged from the terminal.

The conditioned air is supplied to each of the terminals from a central station refrigeration machine via suitable ducts. The terminals include a plenum section in communication with a supply duct. The terminals further include a distribution chamber having the air regulating assembly disposed therein. A plate, having a plurality of openings, is interposed between the plenum section and the distribution chamber.

In newer terminals, it has been deemed desirable to increase the quantity of conditioned air discharged therefrom to meet the requirements of certain applications. It has been necessary to provide a second air regulating assembly in the newer terminals of the type described to accommodate the increased quantity of air flowing through the unit. The second assembly defines an air flow path parallel to the flow path defined by the first assembly. The air passing through the opening regulated by the inflatable bellows undergoes a drop in pressure. It is believed the pressure differential thus acting on the air regulating assemblies causes vibratory movement. When the terminals only contained one air regulating assembly, noise generated as a result of the vibratory movement was not noticeable.

The introduction of the second assembly intensifies any noise generated as a result of vibratory or relative movement of each assembly. It is believed that such intensified sound generation is caused by resonance between the two regulating assemblies.

Accordingly, any noise resulting from the vibratory movement of either of the assemblies will result in undesirable noise in the room or space being conditioned. It is therefore essential that vibratory movement of the assemblies be eliminated.

SUMMARY OF THE INVENTION

It is an object of this invention to maintain air regulating assemblies employed in an air conditioning terminal stationary relative to non-movable elements of the terminal.

It is a further object of this invention to prevent vibratory or relative movement of air regulating assemblies employed in an air conditioning terminal.

It is yet another object of this invention to prevent undesirable generation of noise by vibratory movement of air regulating assemblies.

These and other objects of the present invention are obtained in an air conditioning terminal to supply conditioned air into a space and including a first section connected to a source of conditioned air. The terminal further includes a discharge section to direct the air from the terminal into the space, and a pair of assemblies interposed between the first and discharge sections, for regulating the quantity of air discharged from the terminal. A member is connected to the air regulating assemblies, and to a non-movable portion of the terminal to prevent relative or vibratory movement between the assemblies and the non-movable portion of the terminal. Generation of noise by the relative movement of the assemblies is thus prevented.

DESCRIPTION OF THE PREFERRED EMBODIMENT

Figure 1:
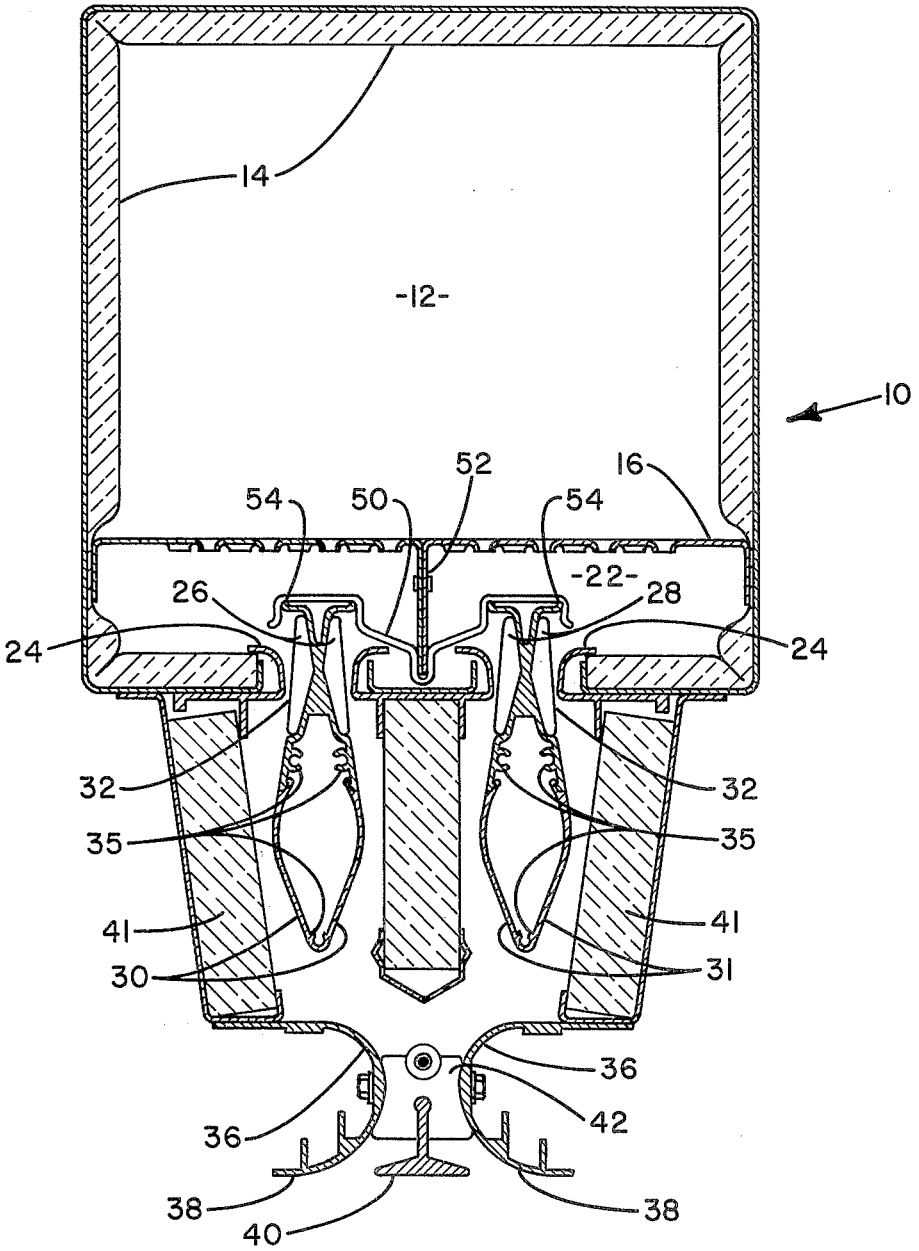
FIG. 1 is a sectional, somewhat schematic view illustrating an air conditioning terminal in accordance with the present invention.
Figure 2:
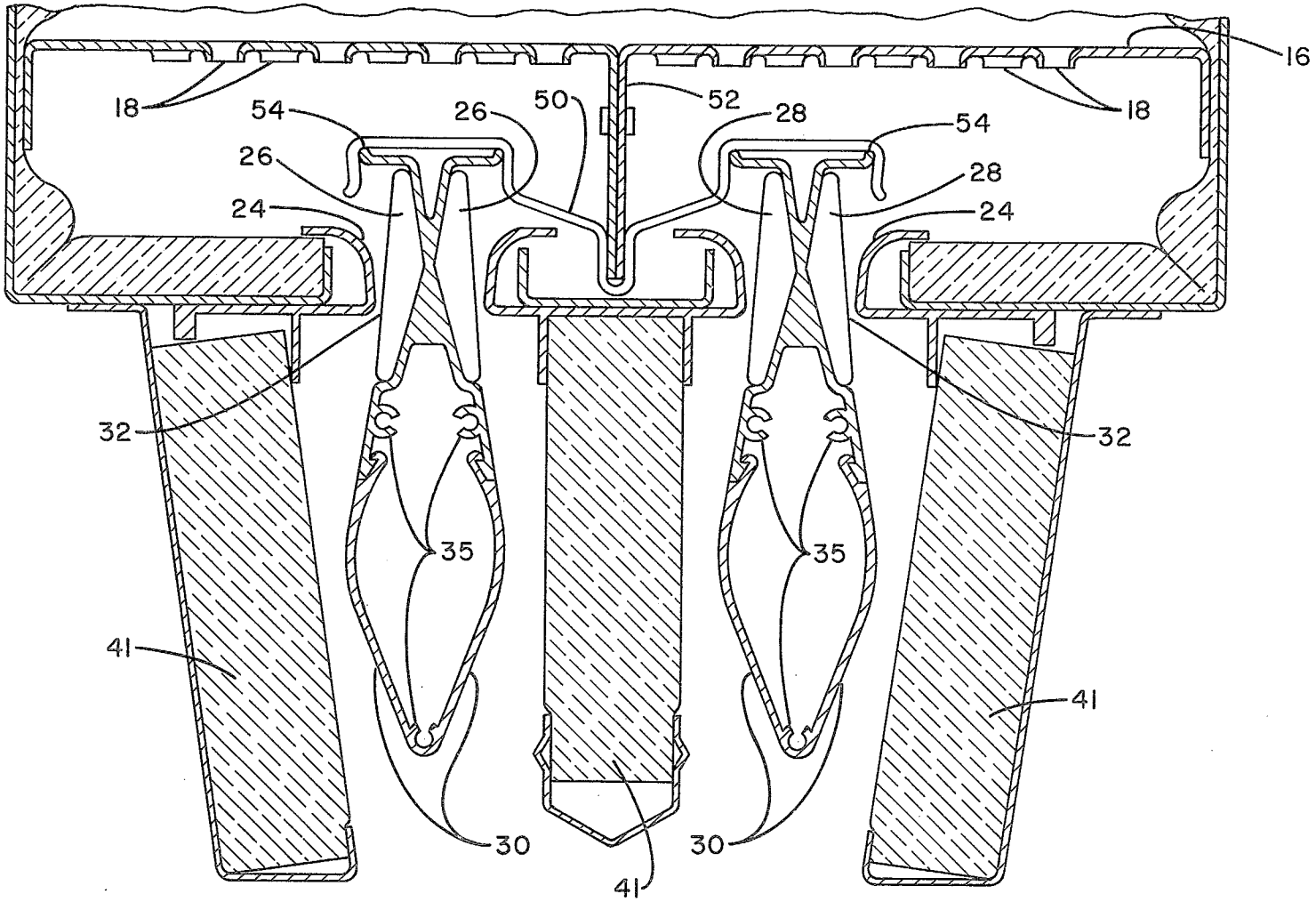
FIG. 2 is an enlarged sectional, somewhat schematic view of a portion of the air conditioning terminal illustrated in FIG. 1.

Referring now to the drawings, there is shown an air conditioning terminal illustrating a preferred embodiment of the present invention. In referring to the several figures of the drawings, like numerals shall refer to like parts.

Referring now particularly to FIG. 1 of the drawings, there is disclosed an air conditioning terminal 10. Terminal 10 is representative of air conditioning terminals which are designed to be mounted in the ceiling of rooms or spaces being conditioned. Terminal 10 is provided as a part of an air conditioning system generally including central air conditioning apparatus which may comprise a filter, pre-cooling coil, spray means, a cooling coil, a heating coil, and a fan for heating, cooling, dehumidifying, humidifying and filtering the air as desired. The fan is provided to distribute the conditioned air through supply ducts which are provided to supply the conditioned air to the air conditioning terminals located throughout a building.

Terminal 10 includes a primary chamber or plenum section 12, lined with a sound absorbing blanket 14, such as a glass fiber blanket. The plenum section is ordinarily open at both ends for connecting a series of terminals end to end to provide a complete air distribution system. Suitable end pieces, not shown, are utilized to cap end terminals in the series. An air supply distribution plate 16, having a plurality of openings 18 is provided to evenly distribute supply air from plenum section 12 into distribution chamber 22, which is defined by the top and side walls of distribution plate 16.

The bottom of distribution chamber 22 includes aligned cut-off plates 24. The plates cooperate with selectively inflatable bellows or bladders 26, and 28, to form a pair of air regulating or damper assemblies. Bladders 26 and 28, when fully inflated, typically form a pear-shaped configuration. Each of the bladders are adhesively mounted on a central partition assembly comprised of opposed generally convex plates 30 and 31. These plates have a V-shaped recess therein so the bladders are completely recessed within the plates when they are deflated. This provides a large area between the active walls 32 of the bladders and the cut-off plates for maximum air flow therebetween. Further, the recessed bladder provides a smooth surface along the plates 30 and 31, to minimize air turbulence. Walls 32 of the bladders are normally concave. Therefore, when the bladders are fully deflated, the active walls of the bladders are out of the air stream to minimize the possibility of bladder flutter. By recessing the bladders within plates 30 and 31 and by providing the bladders with concave wall 32, the distance between the cut-off plates and wall 32 of the bladders is increased. This provides a greater opening between the bladders and cut-off plates when the bladders are fully deflated for maximum air flow therebetween. Further, a large movement of wall 32 from the concave to a convex position may be obtained without stretching the bladder material. Plates 30 and 31 include slotted openings 35 to receive suitable means, such as screws or bolts, to connect the plates to end plates not shown.

An outlet assembly comprises side diffuser members 36 having outwardly flared lower portions 38 thereon and center diffuser member 40 are suitably connected to member 42 which functions as a connecting piece to join the three diffuser members into a subassembly. The terminal further includes sound absorbing material, such as glass fiber blankets 41 disposed downstream of the air regulating assemblies. The fiber blankets absorb sound waves of mid and high frequency. The blankets are ineffective in attenuating sound in the low frequency range.

Essentially, the ceiling air terminal hereinbefore described is of conventional construction and is more fully disclosed in the previously cited U.S. Pat. No. 3,554,111. The distinction between the terminal described hereinabove, and the terminal illustrated in the aforecited patent is the present addition of a second air regulating assembly. It has been found that, in order to satisfy the requirements for many applications, it has been necessary to increase the quantity of conditioned air capable of being supplied from the terminal. Heretofore, the maximum quantity of air that units of the type described have been able to provide has been approximately 200 cfm.

In order to effectively control the discharge of an increased quantity of conditioned air, it has been necessary to provide the second air regulating or damper assembly. The second air regulating assembly defines a second conditioned air flow path parallel to the conditioned air flow path defined by the first air regulating assembly. As noted previously, the second assembly includes an additional pair of cut-off plates, bladders, and partition assembly comprising the pair of convex plates.

In air conditioning units of the type described, it is essential that the noise generated therefrom be maintained at a minimum level since the units are typically employed to provide conditioned air into occupied spaces. Heretofore, in units employing a single air regulating assembly, any slight vibratory movement of the assembly whereby low frequency noise might be generated has been either unnoticed or tolerated, since the noise has been at a minimum level. The vibratory movement of the air regulating assemblies has been caused by the pressure differential established as a result of the air passing through the openings defined between plates 24 and bladders 26, 28. However, the introduction of a second assembly has intensified the low frequency noise generated as a result of the vibratory movement of each of the assemblies. It is believed the intensified noise generation has resulted from resonance between the two assemblies. Accordingly, it is essential that the vibratory movement of the assemblies resulting from air flow thereacross be reduced or eliminated.

In order to accomplish the foregoing, a restraining member 50 is connected to the air regulating assemblies and to a non-movable portion of the air terminal, for example flange 52. Restraining member 50 is illustrated as formed from generally spring-like material. The restraining member engages upstanding arms 54 of the convex plates of each of the assemblies and in addition, firmly engages flange section 52. The restraining member is in direct contact with the outer surfaces of arms 54 and with the outer surface of flange 52 to prevent any movement of the assemblies in a horizontal plane. It has been observed, substantially the entire undesired movement of the assemblies is in the horizontal plane. By maintaining the air regulating assemblies under tension in the foregoing manner, the assemblies are prevented from moving relative to the stationary parts of the terminal. Elimination of vibratory movement of the assemblies eliminates low frequency noise generated thereby.

It should be understood that while one form of restraining means has been illustrated, other means to prevent relative movement of the assemblies may be employed.

While a preferred embodiment of the instant invention has been described and illustrated, the invention should not be limited thereto, but may be otherwise embodied within the scope of the following claims.

We claim:

1. In an air conditioning terminal for supplying conditioned air into a space and including a plenum section connected to a source of conditioned air and a distribution chamber having a pair of assemblies for regulating the quantity of conditioned air discharged into the space, and means interposed between said plenum section and said distribution chamber for passage of conditioned air from said plenum section into said chamber, the improvement comprising:

each of said air regulating assemblies including a pair of inflatable bladders mounted on a support member, each support member having at least two spaced apart upstanding arms; and a restraining member formed from spring-like material and connected to a non-movable portion of said terminal and to the outer surface of each upstanding arm of said support members to provide opposed horizontal forces on said upstanding arms to prevent relative movement in any direction in at least one plane between said air regulating assemblies and said non-movable portion whereby generation of noise by the relative movement of said assemblies is prevented.

* * * * *